US005386080A

United States Patent [19]

Brashears

[11] Patent Number: 5,386,080

[45] Date of Patent: Jan. 31, 1995

[54] APPARATUS AND METHODS FOR CONTROLLING HIGH TEMPERATURE GASES

[75] Inventor: David F. Brashears, Belle Isle, Fla.

[73] Assignee: Thermotech Systems Corporation, Orlando, Fla.

[21] Appl. No.: 994,921

[22] Filed: Dec. 22, 1992

[51] Int. Cl.[6] ..... A62D 3/00; F28F 27/00; B01J 8/00; C22B 26/10

[52] U.S. Cl. ..... 588/208; 165/103; 423/245.3; 422/200; 405/258

[58] Field of Search ..... 588/208; 431/5, 202; 110/210, 211; 405/258; 165/931, 103; 261/DIG. 11; 422/200, 202; 423/245.3; 55/223, 125; 137/251.1

[56] References Cited

U.S. PATENT DOCUMENTS

| | | | |
|---|---|---|---|
| 1,079,849 | 11/1913 | Ernst | 55/223 |
| 1,261,106 | 4/1918 | Crisfield | 55/223 |
| 3,901,643 | 8/1975 | Reed et al. | 431/202 |
| 4,229,157 | 10/1980 | Ito et al. | 431/90 |
| 4,605,423 | 8/1986 | Koog | 48/69 |
| 4,705,542 | 11/1987 | Gilmer | 55/223 |
| 4,925,389 | 5/1990 | DeCicco et al. | 432/106 |
| 5,164,158 | 11/1992 | Brashears et al. | 422/1 |

*Primary Examiner*—Gary P. Straub
*Attorney, Agent, or Firm*—Nixon & Vanderhye

[57] ABSTRACT

The contaminants in the material are volatilized in a drum having a burner. The volatilized contaminants are separated from material particulates in a separator and are preheated in a heat exchanger for flow into an afterburner. The afterburner burns the volatilized contaminants to provide a clean exhaust gas to the hot side of the heat exchanger, the clean exhaust gas being cooled in the heat exchanger and exhausted to a stack. To control the exhaust temperature of the afterburner to the heat exchanger, a bypass conduit from the afterburner flows exhaust gases through a water seal valve bypassing the heat exchanger. The level of water in the valve can be adjusted to modulate the flow of hot clean exhaust gases from the afterburner bypassing the heat exchanger, thereby to control the temperature at the inlet of the heat exchanger.

8 Claims, 3 Drawing Sheets

APPARATUS AND METHODS FOR CONTROLLING HIGH TEMPERATURE GASES

TECHNICAL FIELD

The present invention relates generally to controlling flow of high temperature gases exhausting from a burner. More particularly, the present invention relates to apparatus and methods for controlling exhaust gas flow resulting from the thermal oxidation of volatilized contaminants and more specifically relates to apparatus and methods for controlling the temperature in a heat exchanger forming part of a system for remediating materials, such as soils, contaminated with organics, for example, hydrocarbon products and hydrocarbon chemicals, such as PCBs, wherein the contaminants are first volatilized and later burned in an afterburner.

BACKGROUND

In many high temperature applications, there is a requirement for valves which will seal and control the flow of high temperature exhaust gases. It is, however, extremely difficult in this high temperature environment, which in many situations is also a high temperature contaminated environment, to provide flow control valves without using very expensive materials or exotic designs. Most commonly used materials for valves for low temperature operations cannot stand up to high temperature or contaminated gas streams with the expectation that such valves will have a useful economical life expectancy.

An example of such environment is in a steel mill, where the off-gases from the blast furnace are hot, dirty and combustible. These off-gases are typically routed through a "stove" where the stove bricks are heated by the gases. While the stove is being heated, a second stove, previously heated by the off-gases, preheats combustion air flowing through it for combustion in the blast furnace. Combustion air is therefore routed alternately between two or more such "stoves" in order to preheat the combustion air. Where two such stoves are used, at least two three-way valves are employed to route the exhaust gas from the blast furnace to one or the other of the stoves and the preheated combustion air from the stoves to the blast furnace, respectively. These valves are necessarily specifically designed and use exotic materials to withstand the high temperatures to which they are exposed in order to control the flow of the high temperature gases in the various conduits.

Similarly as in the above-described steel mill application, there are a number of regenerative fume incinerators that use the afterburner off-gases to alternately heat refractory media such that the refractory media can alternately preheat gases, usually contaminated, to be incinerated. Valving arrangements, as previously described in the steel mill application, are likewise necessary in regenerative fume incinerators.

Another application of a valve used in high temperature applications is in hazardous waste incinerators. In equipment of this type, there is typically an emergency exhaust vent for dumping the gases in the event of the failure of a quench system. Because of the high temperatures and the need to use refractories, the vent becomes very heavy. This, in turn, presents problems in opening the valve in the event of power failure, as well as obtaining a good seal on the valve to avoid leakage during normal operation.

A further example of a valve for use in high temperature operations is in cogeneration plants. To produce maximum electrical generation from a turbine, oftentimes the exhaust gases are bypassed around the waste heat boiler. Those exhaust gases are at sufficiently high temperature to require valves of exotic designs and specialized, oftentimes expensive, materials. The high temperature flow control apparatus of the present invention, as indicated above, has many applications in a high temperature gaseous environment. The following description relates to the use of a high temperature valve for use in the exhaust gas conduit of a soil remediation unit. For controlling the flow of high temperature exhaust gases from a burner and particularly for controlling the temperature of such exhaust gases used to preheat contaminated gases flowing to an afterburner, it will be appreciated that the invention has the more general application described above.

While the preferred embodiment of the present invention is described herein in relation to the remediation of soil contaminated with hydrocarbons, it will be appreciated that materials other than soil may be remediated in the practice of this invention. For example, the present invention may be used to eliminate volatile organics from metal turnings, sludges, drilling muds, inorganic chemicals, etc., with the temperature of the heat exchanger being controlled in a thermally efficient manner.

Soils are frequently contaminated with volatile organics, e.g., hydrocarbon products, and this constitutes a highly significant and major pollution problem. The contaminants may range from gasoline through heavy hydrocarbon products and hydrocarbon chemicals, such as PCBs. Various efforts have been directed to remediating contaminated material, such as soil, and one of the most effective is to thermally treat the material. High cost, however, is an inhibiting factor and, in many cases, is the result of inefficiently designed equipment and limited equipment capabilities. For example, a major factor affecting cost is fuel efficiencies in the downstream treatment of the residual gaseous components driven off from the contaminated materials. In prior systems, the basic process for cleaning contaminated material such as soil is to expose it to high temperatures, where the contaminants are volatilized and subsequently burned.

In a conventional soil remediation unit, a rotary drum is provided having a contaminated soil inlet and a clean soil outlet at respective opposite ends of the drum. A burner flows hot gases of combustion in counterflow relation to the contaminated soil passing through the drum. The flow of hot combustion gases, in contact with the contaminated soil, volatilizes the contaminants and substantially remediates the soil. The hot gases of combustion containing the volatilized contaminants, as well as particulates from the soil, such as dust, are passed through a separator, where the particles are separated out. The resulting exhaust gases containing the volatilized contaminants are then passed into an afterburner, where the contaminants are completely burned to provide a clean exhaust gas. The volatilized contaminants thus provide fuel for the afterburner. In thermally efficient systems of this type, the high temperature stack gases from the afterburner are disposed in heat exchange relation with the volatilized contaminant-laden exhaust gases incoming from the separator before the latter gases are disposed in the afterburner. Those volatilized, contaminant-laden exhaust gases are therefore preheated, thereby conserving the fuel supply to the afterburner. The heat exchanger also cools the stack gases. Consequently, the heat exchanger adds substantial efficiency to the system.

It has been found, however, that for high contamination levels in the material, such as soils, more fuel than actually needed in the afterburner is supplied to the afterburner in the form of the volatilized contaminants, resulting in a runaway condition with respect to the temperature of the gases exhausting from the afterburner. Stated differently, if the contaminated soil has one or more "sweet spots," and sufficient organic material is driven off in the drum to supply more fuel in the afterburner than the afterburner needs, the exhaust gas temperature of the afterburner will rise as those additional fuel-supplying contaminants are burned. Thus, for low and moderate contamination levels in the material, i.e., soil, the heat exchanger serves to conserve the fuel supplied to the afterburner. For highly contaminated soil or sweet spots, the temperature of the exhaust gases rises to such an extent that it causes problems in the heat exchanger absent use of very expensive materials and constructions. It is therefore highly desirable to maintain the exhaust gas temperature of the afterburner below a predetermined maximum temperature, e.g., 1000° F.

Bypassing the hot exhaust gases from the heat exchanger has been considered. However, bypassing these hot gases, which can reach as high as 1800° F., constitutes a materials problem. For example, providing for thermal expansion in the heat exchanger, a valve which can seal off or modulate the exhaust gases when you want to bypass and still give reasonable life expectancy, and bearings for a damper assembly under those high temperature conditions causes very real practical problems requiring very expensive parts. Consequently, on the one hand, for low and moderately contaminated materials, use of a heat exchanger in preheating the volatilized contaminant-laden exhaust gases from the drum increases the efficiency of the afterburner. However, on the other hand, when the volatilized contaminants from highly contaminated materials or sweet spots are supplied and serve as fuel to the afterburner in excess of its capacity and the temperature therefore rises beyond acceptable limits, a runaway condition occurs in which the system, and particularly the heat exchanger, may be damaged by the high temperatures. Thus, an improved system is required which maximizes fuel efficiency for low and moderately contaminated soils with substantial fuel savings benefits, and enables bypass with modulation of very hot exhaust gases when highly contaminated soils are encountered.

DISCLOSURE OF THE INVENTION

According to the present invention, there is provided a system for remediating contaminated materials including a drum having a burner for volatilizing the contaminants, a separator for separating the contaminants from particles in the exhaust gas from the drum into a volatilized contaminant-laden exhaust gas stream, and an afterburner wherein the volatilized contaminants in the exhaust gas stream are burned using the burner fuel supply for the afterburner and the contaminants themselves as fuel for the afterburner. Additionally, the present invention provides a heat exchanger for preheating the volatilized contaminant-laden exhaust gases from the separator prior to disposing those gases in the afterburner and using the clean exhaust gases of the afterburner as the heating medium. That is, in the present system, the heat exchanger preheats the volatilized contaminant-laden exhaust gas stream and cools the clean exhaust gas from the afterburner. To prevent a portion of the clean exhaust gases from passing through the heat exchanger, a bypass conduit lies in communication with the exhaust gases adjacent the exit end of the afterburner. A water seal is employed at the end of the bypass conduit to exhaust a portion of the clean exhaust gases, as well as to modulate the clean exhaust gas flow through the bypass conduit.

In one form of the invention, the end of the bypass conduit is disposed below the level of fluid, i.e., water, in a tank, and preferably has one or more slots in the conduit end. By adjusting the relative level of the fluid and the end of the bypass conduit, the magnitude of the openings through the slots is controlled. For example, by lowering the fluid level, the slots are opened to a greater extent, enabling the clean exhaust gases to exit through the bypass conduit into a stack. Conversely, by adjusting the relative level of the fluid and slots, the magnitude of the flow area through the slots can be decreased, whereby a greater proportion of the clean exhaust gases flow through the afterburner into the heat exchanger. Consequently, the temperature of the heat exchanger can be controlled by modulating the bypass of the clean exhaust gases.

In another form of the invention, the bypass conduit flows clean exhaust gases into a closed vessel containing the fluid. A stack is disposed below the level of the fluid and has similar openings, as in the prior embodiment, such that by adjusting the level of the fluid in the closed vessel relative to the slots in the stack, the magnitude of the flow of clean exhaust gases bypassing the heat exchanger can be controlled and hence the temperature of the heat exchanger can likewise be controlled.

With the foregoing invention, the modulation of the flow of hot clean exhaust gases can be controlled at low cost, using very inexpensive materials, and with effective control by either adding or removing fluid to control the fluid level in the tank or vessel. An additional advantage resides in the design of the water seal valve such that the stack gases bypassed from the afterburner can be cooled.

In a preferred embodiment according to the present invention, there is provided a method of controlling the temperature magnitude of exhaust gases flowing through a heat exchanger receiving an exhaust gas stream from which volatilized contaminants separated from material containing volatilizable contaminants are burned in an afterburner comprising the steps of heating material containing volatilizable contaminants to a temperature to volatilize the contaminants and provide a particle and volatilized contaminant-laden exhaust gas stream, leaving the material substantially free of the contaminants, separating the volatilized contaminants and the particles in the particle and volatilized contaminant-laden exhaust gas stream from one another to provide a stream of volatilized contaminant-laden exhaust gas, burning the volatilized contaminants in the volatilized contaminant-laden gas stream in an afterburner to create substantially clean exhaust gases, passing the clean exhaust gases from the afterburner in heat exchange relation with the volatilized contaminant-laden exhaust gas stream prior to introducing the volatilized contaminant-laden exhaust gas stream into the afterburner to raise the temperature of the volatilized contaminant-laden exhaust stream entering the afterburner and cool the clean exhaust gases, bypassing a portion of the clean exhaust gases exiting the afterburner from the heat exchanger and variably controlling the magnitude of the portion of the clean exhaust gases bypassing the heat exchanger, thereby to control the temperature of the heat exchanger.

In a further preferred embodiment according to the present invention, there is provided, in a system having a heat exchanger and an afterburner for burning volatilized contaminants in volatilized contaminant-laden exhaust gases supplied to the afterburner, apparatus for controlling the temperature, of the heat exchanger comprising an afterburner having a burner, a fuel supply and an inlet to the afterburner for supplying the volatilized contaminant-laden gases such that the burner burns in the afterburner the fuel from its supply and the volatilized contaminants of the exhaust gases to produce substantially clean exhaust gases. Also provided is a heat exchanger for placing the volatilized contaminant-laden gases supplied to the afterburner in heat exchange relation with the clean exhaust gases from the afterburner thereby to preheat the volatilized contaminant-laden gases and cool the clean exhaust gases. A bypass conduit is in communication with the afterburner for bypassing a portion of the clean exhaust gases from the heat exchanger. Means are provided for controllably varying the magnitude of the clean exhaust gases from the afterburner bypassing the heat exchanger in the bypass conduit to control the temperature of the heat exchanger.

In a further preferred embodiment according to the present invention, there is provided, in a system having a burner for generating high temperature exhaust gases, apparatus for controlling the flow of the exhaust gases, comprising a first conduit in communication with the burner for receiving the high temperature exhaust gases and a second conduit for receiving a controlled flow of the exhaust gases from the first conduit. A valve is interposed between the first and second conduits including a container for a fluid for controlling the flow of the high temperature exhaust gases from the first conduit to the second conduit. One of the conduits has an opening and an end for reception in the container below the level of fluid in the container. Means are provided for adjusting the relative height of the end of one conduit and the level of fluid in the container to adjust the extent to which the opening is occluded by the fluid thereby controlling the flow of exhaust gases between the first and second conduits.

Accordingly, it is a primary object of the present invention to provide a novel and improved system for controlling the temperature of a heat exchanger processing clean exhaust gases resulting from the burning of contaminants volatilized from materials undergoing remediation.

BEST MODE FOR CARRYING OUT THE INVENTION

Reference will now be made in detail to a present preferred embodiment of the invention, an example of which is illustrated in the accompanying drawings.

Figure 1:
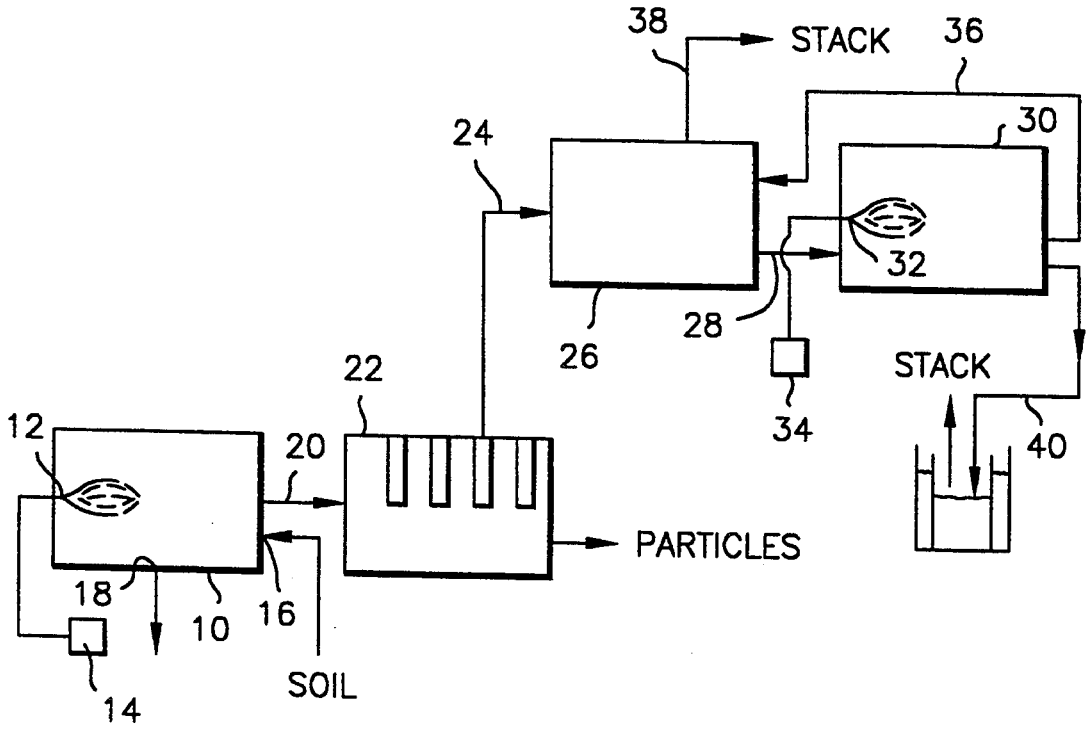
FIG. 1 is a schematic illustration of a system for controlling the magnitude of clean exhaust gases flowing to a heat exchanger resulting from the burning volatilized contaminants removed from materials undergoing remediation in accordance with the present invention.

Referring now to FIG. 1, there is schematically illustrated a drum 10 having a burner 12 at one end supplied with fuel from a fuel supply 14. Drum 10 includes an inlet 16 for receiving contaminated materials, such as soil, and an outlet 18 for discharging substantially clean and remediated soil. Drum 10 is rotatable about an inclined, generally horizontal axis, and hot gases of combustion generated by burner 12 are preferably in counterflow relation with the soil undergoing remediation and received in the drum at inlet 16. Exhaust gases from drum 10 containing the volatilized contaminants, as well as particulates from the materials undergoing remediation, flow through conduit 20 to a separator 22. In the preferred form of the present invention where soil is being remediated, separator 22 may comprise a baghouse in which bags of filter material depend from a chamber or plenum in communication with the interior of the bags whereby the volatilized contaminant-laden gases are separated from the particles of the materials, i.e., soil, undergoing remediation. The soil particles are disposed of in any suitable manner and may be recycled back to the burner 10. The volatilized contaminant-laden exhaust gases from the separator flow through a conduit 24 and into a heat exchanger 26. These gases are preheated in heat exchanger 26, for example, in the case of soil, from about 300° F. at the heat exchanger inlet to about 900° F. at its outlet for flow via conduit 28 into an afterburner 30. Afterburner 30 essentially comprises an elongated cylindrical vessel, preferably refractory lined, having a burner 32 at one end supplied with the fuel from a fuel supply 34. The volatilized contaminant-laden gases inlet to the afterburner 30 also serve as fuel for the burner thereof whereby the volatilized contaminants are burned to provide a clean exhaust gas. The clean exhaust gas flows through a conduit 36 to heat exchanger 26 and supplies the heat for preheating the volatilized contaminant-laden gases inlet to the heat exchanger 26 from separator 22. The clean exhaust gases inlet to heat exchanger 26 via conduit 36 are thus cooled by heat exchange with the volatilized contaminant-laden gases inlet heat exchanger 26 via conduit 24 and these cooled, clean exhaust gases flow to the stack via conduit 38.

As will be recalled from the preceding description, highly contaminated materials or sweet spots in the materials may cause an excess of volatilized contaminant-laden gases in the afterburner 30 which, when burned, cause an unacceptable increase in the temperature of the exhaust gases. In accordance with the present invention, the magnitude of the exhaust gases to the heat exchanger is controlled by bypassing a portion of the clean exhaust gases from the heat exchanger. It will be recalled that the high temperature of the exhaust gases away has a deleterious effect on the heat exchanger and thus the heat exchanger temperature is maintained below a predetermined maximum temperature, preferably about 1000° F.

Figure 2:
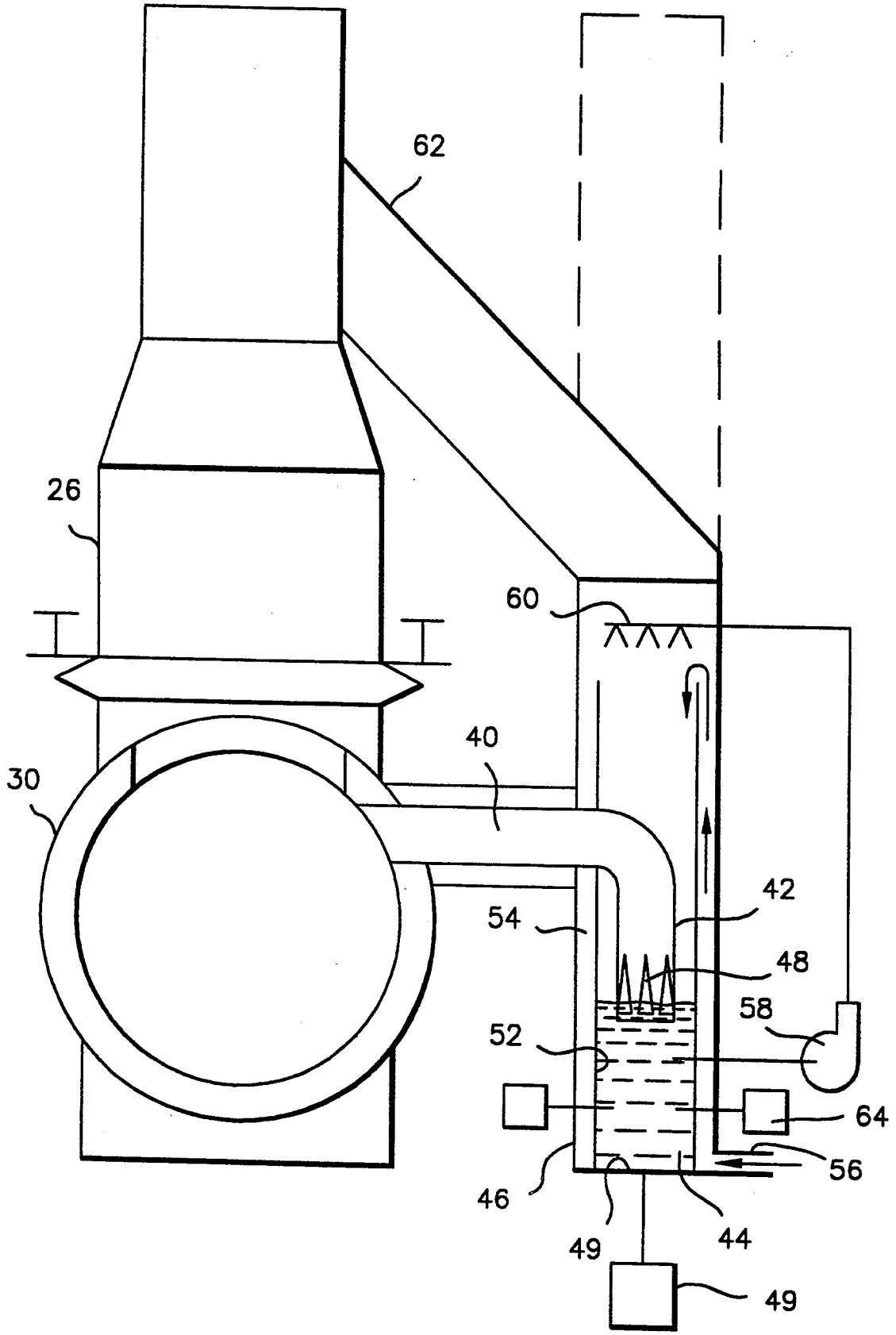
FIG. 2 is a schematic elevational view of an afterburner and bypass assembly for use in the present invention.

To accomplish this and with reference to FIGS. 1 and 2, there is provided a bypass conduit 40 adjacent the exhaust end of the afterburner 30. The bypass conduit 40 is open at one end to the exhaust gases in the afterburner and is turned down intermediate its ends to form essentially a goose neck 42 at its open lower opposite end. The open opposite end of bypass conduit 40 is disposed in fluid 44, preferably water, contained within a tank 46. The lower end of the turned-down bypass conduit 42 is provided preferably with one or more slots opening through side walls of the conduit and arranged peripherally about the conduit end. The tank in this preferred embodiment of the present invention includes a lower sump 49 which is surrounded by a jacket 52 forming an annulus 54 between the walls of tank 46 and the jacket about sump 49. The jacket walls 52 extend well above the level of fluid 44 in the tank 46 and above bypass conduit 40. A fluid inlet 56 is provided at the lower end of the annulus 54 for flowing fluid into the annulus 54 and over its upper end for overflow into the central sump 44. A suitable pump, not shown, is provided for this purpose. Preferably, fluid from the sump 44 is pumped by a pump 58 through a conduit terminating in a spray bar 60 located above the upper end of the annulus 54 and sump 44 for spraying fluid continuously downwardly into the tank and through the clean exhaust gases rising within the tank.

In a preferred form of the present invention, the fluid level in tank 46 is controlled and adjusted in relation to the slots 48 in the bypass conduit 40. More particularly, by raising or lowering the fluid level in tank 46, the magnitude of the opening through the slots 48 above the fluid level can be controlled to a greater or lesser extent. Specifically, when the fluid level in tank 46 is raised to occlude a greater extent of slots 48, flow of hot exhaust gases from bypass conduit 40 through the slots 48 into the stack 62 is reduced. When the level of the fluid is lowered in tank 46, a greater proportion of the openings of the slots 48 are exposed above the fluid level, enabling a greater magnitude of clean hot exhaust gases to flow through the bypass conduit 40 into stack 62. Consequently, the magnitude of the clean exhaust gases of the afterburner flowing through the openings in the slots 48 can be controlled to a greater or lesser extent. By locating a thermocouple, for example, at the inlet to the heat exchanger, the temperature of the clean exhaust gases inlet to the heat exchanger can be measured. The level of fluid in the tank can be raised or lowered. The level of fluid in the tank can be detected by a level control transmitter 64. The pump for pumping fluid into the tank is controlled in response to the temperature sensed by the thermocouple at the heat exchanger to effect a raising or lowering of the level of fluid in the tank. It will also be appreciated that the spray bar 60 cools the clean exhaust gases flowing into the tank through the open portions of the slots 48 to reduce stack exhaust gas temperatures. For removing sediment in the bottom of tank 46, a blowdown structure 49, conventional in steam boilers, may be used.

Figure 3:
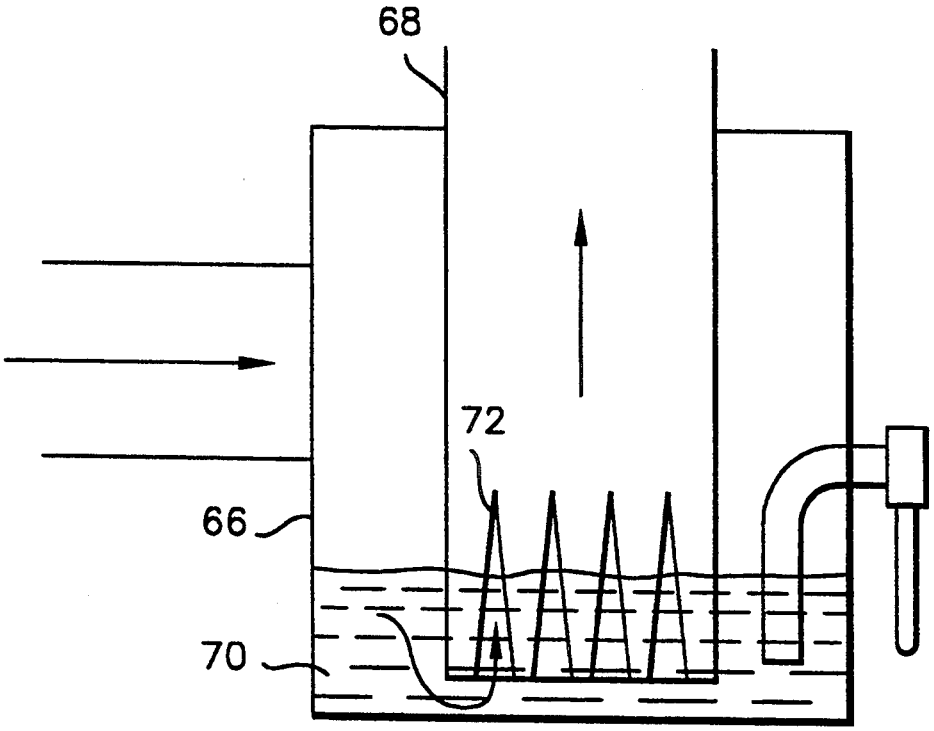
FIG. 3 is another embodiment of the bypass assembly according to the present invention.

With reference to FIG. 3, the bypass conduit 40 may flow clean exhaust gas into a closed vessel 66. An exhaust gas stack 68 comprising a conduit may be disposed in the vessel 66. The conduit 68 has an open lower end which is disposed below the level of fluid 70 in the vessel 66. The lower end of the conduit 68 is similarly provided with preferably a plurality of slots 72 which straddle to a greater or lesser extent the fluid level in vessel 66. Thus, by relatively adjusting the location of the openings or slots 72 and the fluid level in vessel 66, a greater or lesser magnitude of the clean exhaust gases may escape from the afterburner via the stack conduit 68.

While raising and lowering of the fluid level in the tank or vessel is the preferred manner in which the magnitude of the openings through the slots are controlled, it will be readily appreciated that the elevation of the conduit itself in the tank can be adjusted in response to the temperature sensed by the thermocouple at the heat exchanger inlet. Thus, by controllably adjusting the relative level of fluid and the conduit in the tank or vessel, a greater or lesser magnitude of clean exhaust gas may flow from the end of the afterburner to the stack bypassing the heat exchanger, thereby controlling the temperature of the heat exchanger to below a predetermined maximum temperature.

While the invention has been described with respect to what is presently regarded as the most practical embodiments thereof, it will be understood by those of ordinary skill in the art that various alterations and modifications may be made which nevertheless remain within the scope of the invention as defined by the claims which follow.

What is claimed is:

1. A method of controlling the magnitude of exhaust gases flowing through a heat exchanger receiving an exhaust gas stream from which volatilized contaminants separated from material containing volatilizable contaminants are burned in an afterburner comprising the steps of:

heating material containing volatilizable contaminants to a temperature to volatilize the contaminants and provide a particle and volatilized contaminant-laden exhaust gas stream, leaving the material substantially free of the contaminants;

separating the volatilized contaminants and the particles in the particle and volatilized contaminant-laden exhaust gas stream from one another to provide a stream of volatilized contaminant-laden exhaust gas;

burning the volatilized contaminants in the volatilized contaminant-laden gas stream in an afterburner to create substantially clean exhaust gases;

passing the clean exhaust gases from the afterburner in heat exchange relation with the volatilized contaminant-laden exhaust gas stream prior to introducing the volatilized contaminant-laden exhaust gas stream into the afterburner to raise the temperature of the volatilized contaminant-laden exhaust stream entering said afterburner and cool the clean exhaust gases;

bypassing a portion of the clean exhaust gases exiting the afterburner from the heat exchanger;

variably controlling the magnitude of the portion of the clean exhaust gases bypassing the heat exchanger, thereby to control the temperature of the heat exchanger; and disposing an end of a bypass conduit in communication with the clean exhaust gases of the afterburner below the level of fluid in a tank in communication with a stack and including the further step of adjusting the relative height of the end of the bypass conduit and the level of fluid such that a greater or lesser magnitude of gases flow through the bypass conduit to the stack.

2. A method of controlling the magnitude of exhaust gases flowing through a heat exchanger receiving an exhaust gas stream from which volatilized contaminants separated from material containing volatilizable contaminants are burned in an afterburner comprising the steps of:

heating material containing volatilizable contaminants to a temperature to volatilize the contaminants and provide a particle and volatilized contaminant-laden exhaust gas stream, leaving the material substantially free of the contaminants;

separating the volatilized contaminants and the particles in the particle and volatilized contaminant-laden exhaust gas stream from one another to provide a stream of volatilized contaminant-laden exhaust gas;

burning the volatilized contaminants in the volatilized contaminant-laden gas stream in an afterburner to create substantially clean exhaust gases;

passing the clean exhaust gases from the afterburner in heat exchange relation with the volatilized contaminant-laden exhaust gas stream prior to introducing the volatilized contaminant-laden exhaust gas stream into the afterburner to raise the temperature of the volatilized contaminant-laden exhaust stream entering said afterburner and cool the clean exhaust gases;

bypassing a portion of the clean exhaust gases exiting the afterburner from the heat exchanger;

variably controlling the magnitude of the portion of the clean exhaust gases bypassing the heat exchanger, thereby to control the temperature of the heat exchanger; and communicating the clean exhaust gas from the afterburner into a substantially closed vessel containing a level of fluid, disposing an exhaust gas conduit having an opening in said closed vessel, adjusting the relative height of the opening and the level of the fluid in the vessel such that a greater or lesser extent of the opening is occluded by the fluid and a respective lesser or greater extent of the opening lies above the level of the fluid in the vessel.

3. A method of controlling the magnitude of exhaust gases flowing through a heat exchanger receiving an exhaust gas stream from which volatilized contaminants separated from material containing volatilizable contaminants are burned in an afterburner comprising the steps of:

heating material containing volatilizable contaminants to a temperature to volatilize the contaminants and provide a particle and volatilized contaminant-laden exhaust gas stream, leaving the material substantially free of the contaminants;

separating the volatilized contaminants and the particles in the particle and volatilized contaminant-laden exhaust gas stream from one another to provide a stream of volatilized contaminant-laden exhaust gas;

burning the volatilized contaminants in the volatilized contaminant-laden gas stream in an afterburner to create substantially clean exhaust gases;

passing the clean exhaust gases from the afterburner in heat exchange relation with the volatilized contaminant-laden exhaust gas stream prior to introducing the volatilized contaminant-laden exhaust gas stream into the afterburner to raise the temperature of the volatilized contaminant-laden exhaust stream entering said afterburner and cool the clean exhaust gases;

bypassing a portion of the clean exhaust gases exiting the afterburner from the heat exchanger;

variably controlling the magnitude of the portion of the clean exhaust gases bypassing the heat exchanger, thereby to control the temperature of the heat exchanger; and disposing an end of a bypass conduit in communication with the clean exhaust gases of the afterburner below the level of fluid in a tank in communication with a stack and including the further step of forming an opening in the end of the bypass conduit for disposition partially above and below the level of the fluid in the tank, and adjusting the relative height of the end of the bypass conduit and the level of fluid such that a greater or lesser extent of the opening is occluded by the fluid and a respective lesser or greater extent of the opening lies above the level of fluid in the tank.

4. A method according to claim 3 wherein the tank includes a jacket of fluid surrounding a central sump containing the fluid and in which the sump end of the bypass conduit is disposed, and including the further step of pumping fluid into the surrounding jacket to control the level of fluid in the central sump relative to the opening in the bypass conduit.

5. A method according to claim 4 including the step of maintaining the level of fluid in the jacket at an elevation above the level of fluid in the sump to insulate the tank from the clean exhaust gases exiting the bypass conduit.

6. A method according to claim 4 including spraying fluid into the sump to cool the clean exhaust gases exiting the bypass conduit.

7. A method according to claim 4 including removing residual deposits of the fluid from the bottom of the sump.

8. A method according to claim 1 wherein the step of variably controlling includes communicating the clean exhaust gas from the afterburner into a substantially closed vessel containing a level of fluid, disposing an exhaust gas conduit having an opening in said closed vessel, adjusting the relative height of the opening and the level of the fluid in the vessel such that a greater or lesser extent of the opening is occluded by the fluid and a respective lesser or greater extent of the opening lies above the level of the fluid in the vessel.

* * * * *